United States Patent [19]

Adler

[11] 3,934,518

[45] Jan. 27, 1976

[54] TROUGH HATCH LOCK DEVICE

[75] Inventor: Franklin P. Adler, Michigan City, Ind.

[73] Assignee: Pullman Transport Leasing Company, Chicago, Ill.

[22] Filed: Oct. 15, 1974

[21] Appl. No.: 514,341

[52] U.S. Cl. ..... 105/377; 16/47; 52/45; 220/57; 292/175

[51] Int. Cl.[2] ..... B61D 39/00

[58] Field of Search ..... 105/377; 16/47; 52/45; 220/57; 292/175

[56] References Cited

UNITED STATES PATENTS

| | | | |
|---|---|---|---|
| 2,816,683 | 12/1957 | Miers et al. | 105/377 |
| 3,175,518 | 3/1965 | Warheit | 105/377 |
| 3,800,714 | 4/1974 | Stark et al. | 105/377 |

*Primary Examiner*—M. H. Wood, Jr.
*Assistant Examiner*—Richard A. Bertsch
*Attorney, Agent, or Firm*—Richard J. Myers

[57] ABSTRACT

A hopper car roof is provided with a plurality of hatch covers positioned over an elongated trough through which materials are loaded into the car. The hatch covers are locked over the trough by means of a hatch cover locking device which includes a hinge strap adapted to engage adjacent end portions of the trough hatch covers with the strap having an outwardly projecting tab engaged by a locking bar which is tightly held in a closed locking arrangement by means of an improved foot operated latch secured to the hopper roof.

6 Claims, 6 Drawing Figures

TROUGH HATCH LOCK DEVICE

BACKGROUND OF THE INVENTION

1. Field of the Invention

This invention relates to railway hopper cars and in particular to cars having a longitudinally extending hatch opening which is closed off by a trough hatch arrangement. In this particular arrangement the adjacent end portions of each of the individual trough hatch covers are closed off by a locking strap which is securely held in place by a locking bar adapted to be easily and and effectively operated by foot engagement of an operator situated on top of the hopper car.

2. Description of the Prior Art

The prior art is disclosed in U.S. Pat. Nos. 3,552,324; 2,873,696 and 3,800,714. The present invention is an improvement over the structure shown in the foregoing patents.

SUMMARY OF THE INVENTION

The present invention relates to a device for restraining the locking handle or arm used to secure and seal trough hatch covers in the closed position. The present design includes the conventional hinge strap assembly having an outwardly projecting tab which is held in the closed position by means of a hinged arm engaging the tab and the same being connected to a keeper for locking the tab and arm in the closed and sealing position. The keeper includes a vertically extending first guide member which is rigidly secured to the roof outwardly of the hatch cover and is connected to a diagonally extending second guide member having a downwardly and inwardly sloping surface. A suitable resilient seal of conventional type is supported between the hatch covers and the coaming defining the elongated trough hatch opening. The hinged arm which is moved into position for securing the tab of the hinge strap in position is provided with a foot engageable plate at one end thereof. During the locking action the arm is rotated downwardly first into engagement with the inner sloping guiding surface of the second guide element whereupon the operator presses down on the foot engageable plate further holding the arm downwardly and the same thereby being guided inwardly underneath a hook portion provided by the vertically extending first guide. The arm is moved downwardly and may move laterally since it has a loose pivotal mounting with respect to a deck bracket to permit such limited lateral displacement. Upon release of the foot plate by the operator, the arm is urged and moved upwardly by means of the resilient seal into position, locked underneath the hook shaped member supported on the vertical guide. It is thus a primary object of the invention to provide an improved foot operated latch device for locking the hatch covers of a trough hatch arrangement into a closed position.

DESCRIPTION OF THE PREFERRED EMBODIMENT

Figure 1:
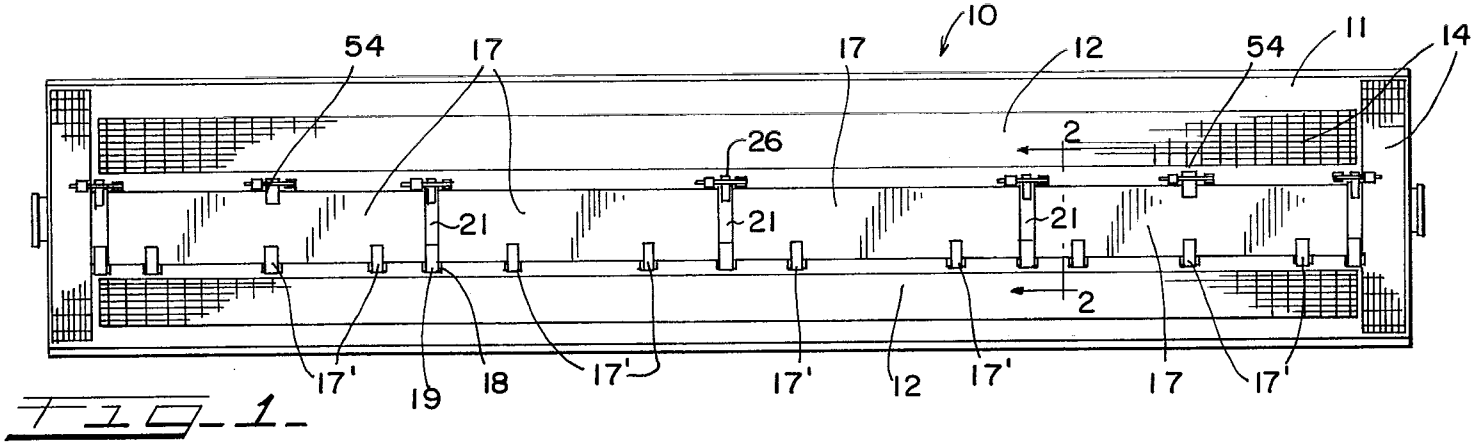
FIG. 1 is a top plan view of a railway hopper car employing a trough hatch locking arrangement.
Figure 2:
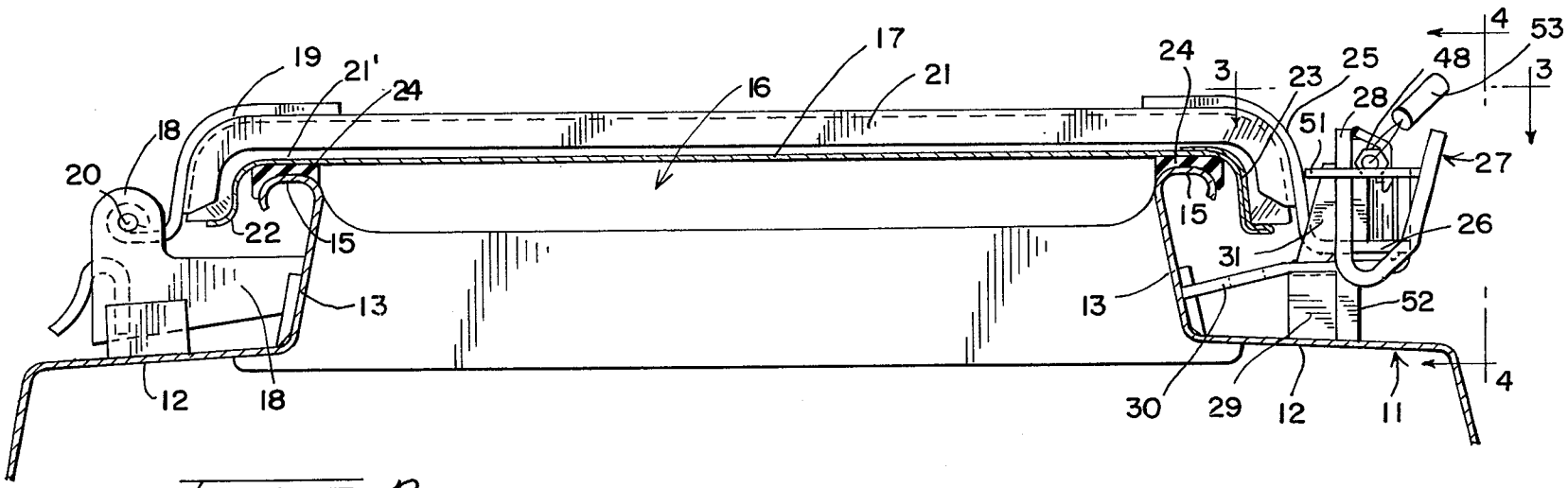
FIG. 2 is an enlarged cross sectional view taken substantially along the line 2—2 of FIG. 1.

Referring now to the drawings, a railway hopper car 10 disclosed in FIG. 1, includes an elongated metal roof structure 11 having stepped roof sheets 12, as best shown in FIG. 2. The stepped roof sheets 12 are provided with elongated vertical coaming walls 13 adjacent to which operator walk ways 14 are positioned substantially the length and width of the car. The vertical coaming walls 13 are coextensive in rectangular relation throughout the length of the stepped roof sheets 12 and include the upwardly extending coaming walls 13 which are provided at their upper ends with outwardly and downwardly projecting arcuate flanges 15. The arcuate flanges 15 define substantially longitudinally extended elongated roof openings 16.

As indicated in FIG. 1, the elongated roof openings 16 are adapted to be covered by means of a plurality of hatch covers 17. The hatch covers 17 are positioned in longitudinally contiguous relation and are connected in a locked position by hinged locking straps to be described. This arrangement is disclosed in U.S. Pat. No. 3,800,714, patented Apr. 2, 1974. As best shown in FIG. 1, the hatch covers 17 are hingedly connected to the roof sheets 12 by means of conventional hinge connections designated at 17', the same being further disclosed in the aforementioned patent.

Figure 4:
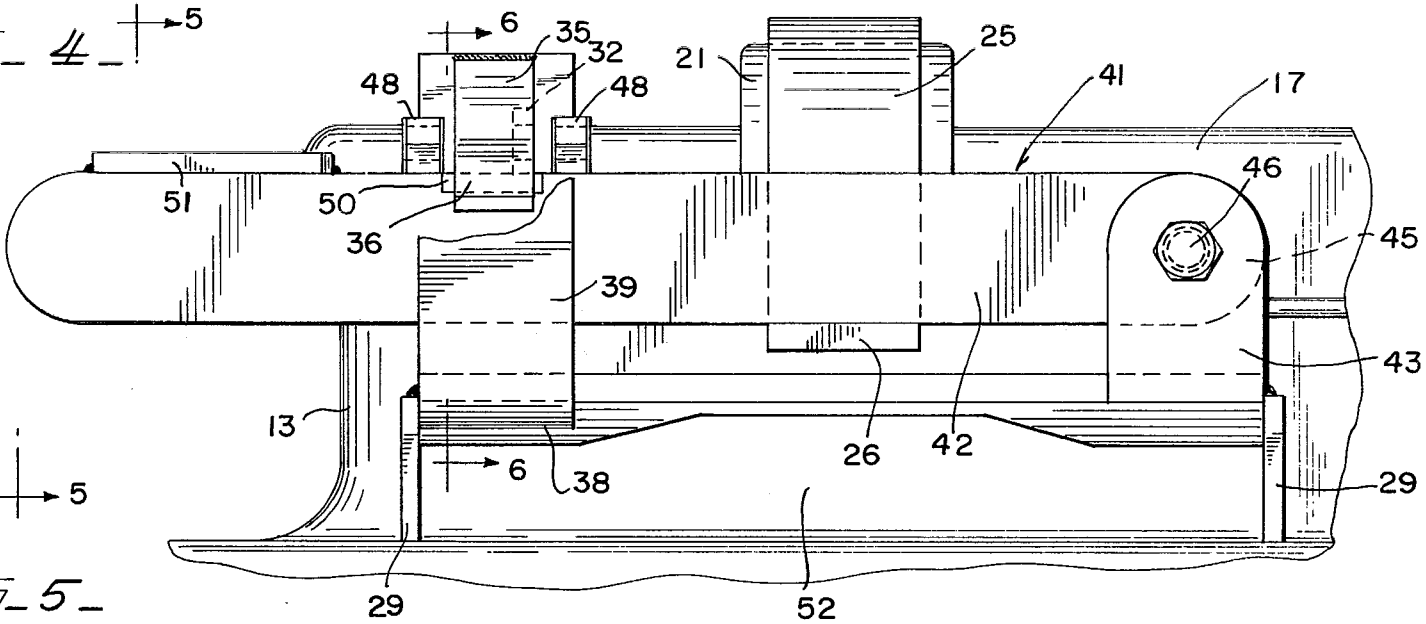
FIG. 4 is a side elevational view taken substantially along the line 4—4 of FIG. 2.
Figure 6:
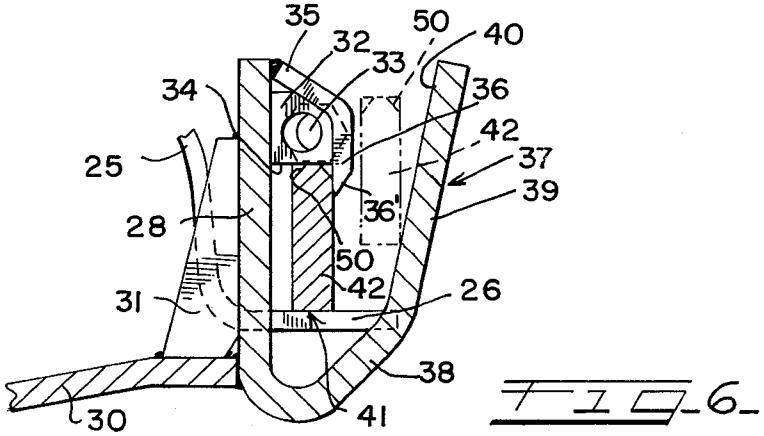
FIG. 6 is a cross sectional view taken substantially along the line 6—6 of FIG. 4.
Figure 5:
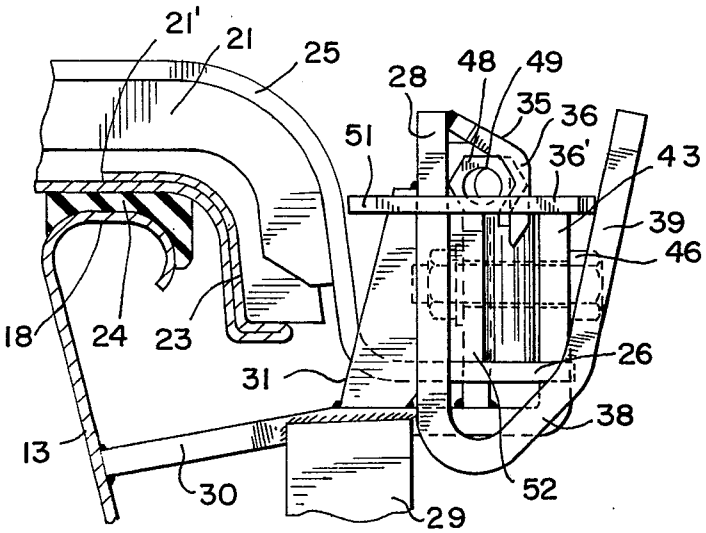
FIG. 5 is a side elevational view partially in cross section taken substantially along the line 5—5 of FIG. 4.

The roof sheets 17 and coaming walls 13 further are provided with upwardly projection hinge brackets 18, as best shown in FIG. 2. The hinge brackets 18 pivotally or hingedly support hinge brackets 19 by means of transversely extending hinge pins 20. Hinge brackets 19 are rigidly secured to U-shaped hinge straps 21 which, as best shown in FIGS. 1 and 2, are adapted to extend over the hatch covers 17. The U-shaped hinge straps 21 also include resilient gaskets 21' which are adapted to engage adjacent edges of the hatch covers 17 (not shown) in sealing relation. The hatch covers 17 include downwardly extending rear flanges 22 and downwardly extending front flanges 23 suitably engaged by the gaskets 21'. The arcuate flanges 15 of the coaming walls 13 have in sealing contact therewith resilient seals 24 which with the hatch cover 17 provide a sealed arrangement. The resilient gasket 21' is in the closed position of the hatch cover, as shown in FIG. 2 in a compressed condition. As best shown in FIGS. 2, 5 and 6, a locking bracket designated 25 includes a horizontal outwardly extending tab 26 which is positioned to extend outwardly adjacent to a keeper assembly generally referred to at 27. The keeper assembly 27 includes a vertical guide member 28 suitably supported on a vertical bracket 29. The vertical bracket 29 is also being reinforced by a laterally extending reinforcing bracket means 30. A vertically extending gusset 31 further secures the vertical guide member 28 in position on the stepped roof sheet 12 and is connected to the coaming wall 13, as disclosed. As best shown in FIGS. 4 and 6, the upper end of the guide member 28 supports a stop block 32 having a longitudinally laterally disposed opening 33. The lower portion of the stop block 32 is provided with a horizontal stop surface 34. A hook is rigidly connected to the top portion of the guide element 28 and extends diagonally downwardly, the same including a vertically extending hook element 36 which projects downwardly from the stop block 32 to provide a keeper retaining means. The hook portion or element 36 is also provided with a tapering surface 36'.

A second guide element is designated at 37, the same being formed integrally with the vertical guide element 28 and including a connector portion 38 which extends diagonally upwardly relative to the lower end of the element 28. The connector portion 38 then is joined by an integral upwardly and outwardly extending guide portion 39 having an inner guide surface 40. Thus, the elements 28, 38 and 39 form in effect a V-shaped type of keeper assembly.

Figure 3:
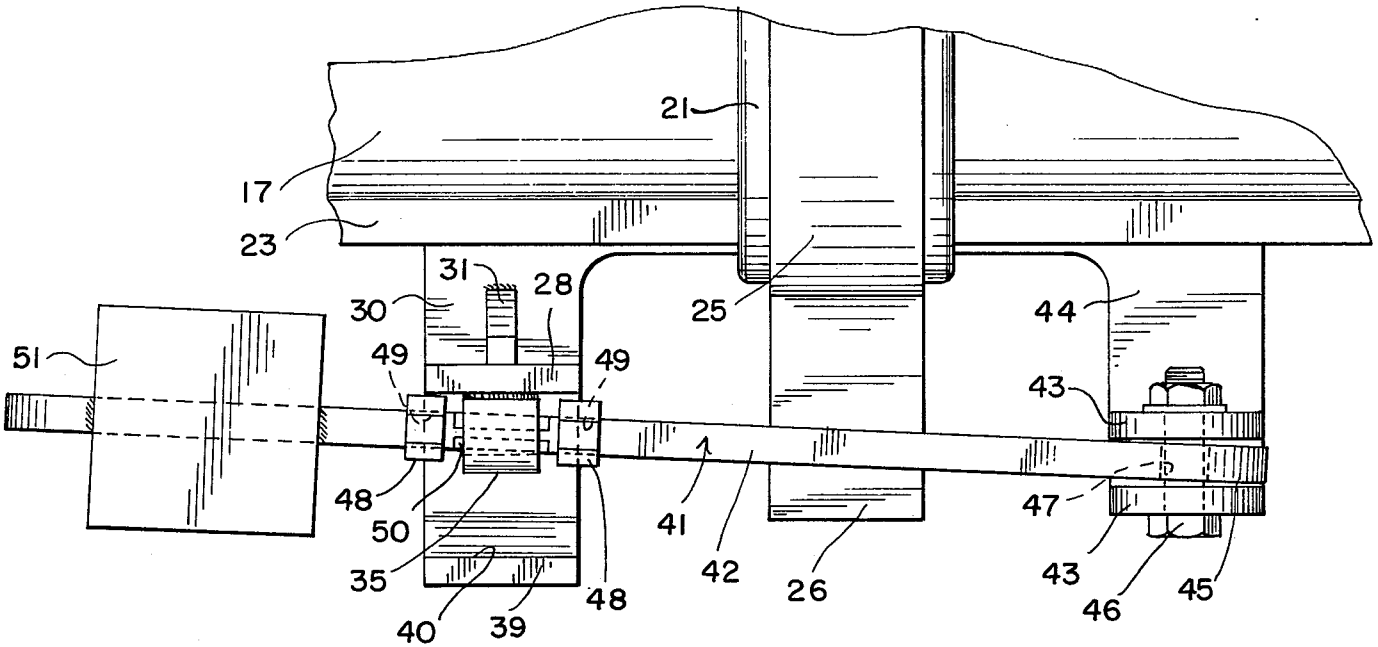
FIG. 3 is a partial elevational view taken substantially along the line 3—3 of FIG. 2.

As best shown in FIGS. 3 and 4, a hold-down arm generally designated at 41 comprises a relatively narrow plate element 42 having substantial height compared to its cross sectional dimension. The arm 42 is disposed between upstanding ears 43 which are suitably supported on a vertically extending connector plate 52 disposed between the brackets 29 and associated structure, which in turn is supported on the roof sheet 12. The hold-down arm 41 further includes a pivoted end portion 45 which is hingedly secured by means of hinge bolt 46 to the upstanding ears 43. The pivoted end portion 45 is provided with an oversize hole 47 so that the arm 41 may be moved or tilted laterally as shown in FIG. 3.

As shown in FIG. 3, the upper surfaces of the arm 41 are also provided with a pair of longitudinally spaced vertical nut shaped elements 48, having openings 49 which are adapted to be placed in registry with the opening 33 of the stop block 32. As best shown in FIGS. 3 and 6, the upper surface of the arm 41 disposed between the nut elements 48 is provided with upper beveled portions 50. The arm 21 is also provided with a flat horizontally disposed foot engageable tread or plate 51. In the closed position shown in FIG. 2, a car seal 53 is connected through the openings 49 and 33, thus blocking the arm 41 in the closed position.

As best shown in FIG. 1, the hatch covers 17 which are disposed at opposite ends of the car may be provided with an additional foot operated latching device 54 which is not provided with the hinge straps 21 but may include a similar keeper and lock arm arrangement for foot operation and providing a central lock for the end covers 17.

THE OPERATION

In the completely open position of the trough hatch the covers 17 are in a position overlying one side of the roof. The hatch covers, after the hoppers have been filled, are then moved to the closed position shown in FIG. 2 and the straps 21 are also moved to the position indicated, thereby engaging the adjacent ends of the covers in sealing relation by virtue of the gaskets 21'. In the open position the arms 41 are supported on the deck to one side of the hinge brackets 43 on the roof structure. To close the hold-down arms 41 they are rotated approximately 180° into the position shown in FIG. 4 wherein they are in a locked position. During this rotation the operator merely places the arms 41 in the broken line position of FIG. 6 and thereupon then places his foot on the foot engageable plate 51 forcing the narrow plate element 42 downwardly. The latter engages the guide surface 40 of the guide member 39 and the plate member is then moved downwardly on said converging surface, pressure of operator's foot then serving to compress the resilient seal 24 as downward pressure is exerted by the arm 42 on the tab 26 of the hinged straps 21. Further continued downward pressure on the arm 41 caused the arm to move downwardly and laterally underneath the hook portion 36, the beveled surfaces 36 and 50 facilitating the movement of the upper end of the plate element 42 into the position shown in FIGS. 5 and 6. The operator then releases his foot from the plate 51 and the seal thereby exerts an upward moving force on the tab portions 26 which in turn further moves the plate element 42 of the arm 41 upwardly until the upper end of the plate 42 engages the stop surface 34 and is captured in said position by means of the hook 36.

Thus, it can be seen that the V-shaped arrangement of the guide elements 28 and 37 with the arrangement of the hook portion provides for a simple, quick and effective manner in which to lock the holddown arm in the keeper position indicated. Therefore, this does not require the operator to utilize wrenches, tools or other means for effecting locking engagement of the hold-down arm by latching mechanism disclosed in the prior art. The latching mechanisms of the prior art become corroded, utilize rotating parts, and are often frozen so that they cannot be readily operated. The present arrangement solves the problem of locking hold-down arms of hatch covers since the arrangement is greatly simplified, requires no other moving parts except the hold-down arm which is always easily moved in position by simply utilizing the foot operated plate arrangement.

In order to release the arms, it is a simple matter to place the foot and weight of the operator on the foot engageable plate 51 and thereby slightly forcing the plate 42 downwardly and laterally whereupon the same is immediately and effectively released by the upward pressure of the compressed seal 24.

What is claimed is:

1. A hopper hatch structure with a roof having an opening surrounded by a hatch coaming and a hatch cover means movably mounted on said roof for engagement with said hatch coaming to close said hatch opening, a locking bracket connected to one side of said hatch cover in the closed position of said cover extending outwardly of said coaming, said locking bracket having a horizontally extending element projecting outwardly of said coaming over said roof, the improvement comprising:

a latching mechanism for securing said cover in the closed position including;

a hold down arm, means pivotally connecting said arm to said roof whereby said arm is swingable into hold down engagement over said horizontal projecting element, keeper means for securing said arm in said hold down position comprising;

a first vertical guide member supported on said roof, hook means projecting laterally outwardly and downwardly from said first guide member, a second vertical guide member laterally disposed with respect to said first guide member for guiding said arm in a lateral direction, said arm having limited lateral movement with respect to said guide members and being movable into locked position downwardly in engagement with said second vertical guide member, then laterally into engaging relation with said hook.

2. The invention in accordance with claim 1, said second guide member extending diagonally upwardly relative to said first guide member.

3. The invention in accordance with claim 1, said arm having a foot engageable portion projecting longitudinally outwardly from said keeper.

4. The invention in accordance with claim 1, said second vertical guide member including an inner guiding surface converging toward and underneath said hook for guiding said arm into engaging relation therewith.

5. The invention in accordance with claim 4, including resilient seal means between said hatch cover and said coaming, said resilient means biasing said engaged arm into engagement with said hook.

6. The invention in accordance with claim 1, said hook including a horizontal stop portion on said first vertical guide member engaged by an upper surface of said arm, and said hook including a downwardly projecting lip extending below said horizontal stop portion.

* * * * *